United States Patent [19]

Dudzinski

[11] 3,952,469

[45] Apr. 27, 1976

[54] METHOD AND APPARATUS FOR CAPPING CELLULAR GLASS BLOCKS FOR THE LOAD BEARING INSULATION OF LIQUEFIED GAS STORAGE TANKS

[75] Inventor: Stanley J. Dudzinski, Trafford, Pa.

[73] Assignee: Pittsburgh Corning Corporation, Pittsburgh, Pa.

[22] Filed: Feb. 6, 1975

[21] Appl. No.: 547,754

[52] U.S. Cl. ..... 52/249; 52/293; 220/9 LG

[51] Int. Cl.[2] ..... B65D 25/18

[58] Field of Search ..... 52/249, 246, 269, 169, 52/404, 293; 62/45; 106/40 R, 40 V; 220/9 LG, 9 F, 9 D; 161/161

[56] References Cited

UNITED STATES PATENTS

| | | | |
|---|---|---|---|
| 2,777,295 | 1/1957 | Bliss et al. | 52/249 X |
| 2,955,049 | 10/1960 | Booth | 106/40 V |
| 3,321,414 | 5/1967 | Vieli | 106/40 V X |
| 3,514,913 | 6/1970 | Nelson | 52/293 X |
| 3,688,938 | 9/1972 | Yamamoto et al. | 220/9 LG |

*Primary Examiner*—J. Karl Bell

*Attorney, Agent, or Firm*—Stanley J. Price, Jr.

[57] ABSTRACT

Load bearing insulation for the base of liquefied gas storage tanks comprises a plurality of courses of cellular glass blocks having horizontal cut faces with open hemispherical cells thereon. A layer of irreversably compressible inorganic particulate material, such as vermiculite, is applied by rolling or screeding on and between each course of cellular glass blocks. The vermiculite particles penetrate the plurality of open hemispherical cells to completely fill the cells. During the application of the vermiculite capping layer, particles are precompressed to bring the vermiculite particles into intimate contact with the open cells. The precompression of the vermiculite capping layer mechanically adheres the particles to the cellular glass block cut face to thus form an irreversibly compressible capping layer on and in between the cellular glass blocks having a compressive strength in the range between about 90 p.s.i. to 180 p.s.i.

12 Claims, 3 Drawing Figures

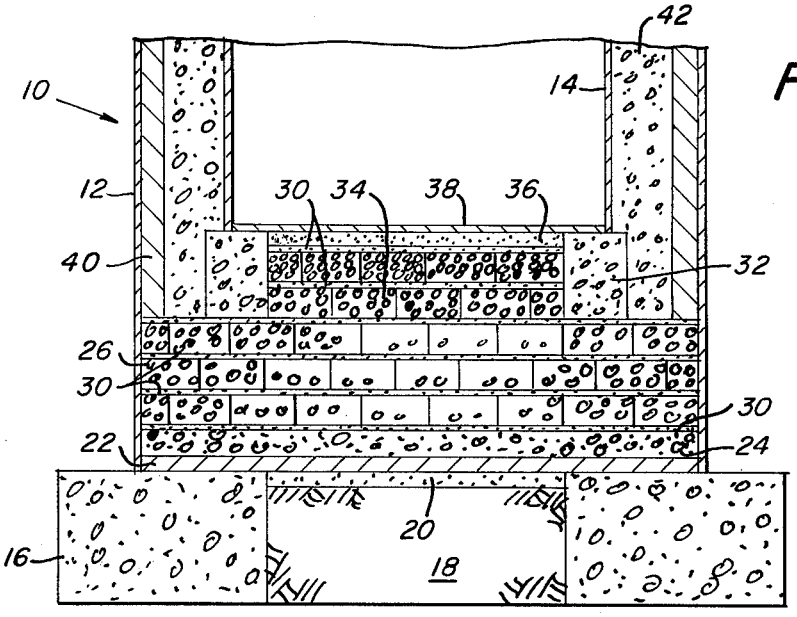
FIG. 1
FIG. 2
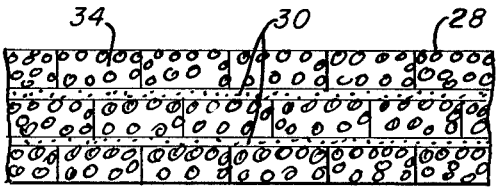
FIG. 3
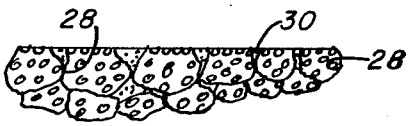

METHOD AND APPARATUS FOR CAPPING CELLULAR GLASS BLOCKS FOR THE LOAD BEARING INSULATION OF LIQUEFIED GAS STORAGE TANKS

BACKGROUND OF THE INVENTION

1. Field of the Invention

This invention relates to a method and apparatus for capping cellular glass blocks utilized as a load bearing insulation for the base insulation of liquefied gas storage tanks and more particularly to the capping of the cellular glass block insulation with a layer of particulate vermiculite to provide a capping which results in improved compressive strength.

2. Description of the Prior Art

In the storage of liquefied gas such as liquefied natural gas (LNG) and liquid oxygen (LOX) in cryogenic strage tanks, cellular glass blocks are commonly utilized as a thermal insulation and a load bearing insulation for the tank base. To increase the compressive strength of the tank base, it is the practice to cap each course of the cellular glass block base insulation with a layer of capping material. This capping layer serves to increase the compressive strength of the cellular glass blocks. The capping material, however, should provide less than a ¼ inch deformation of the total insulation system so that the tank base is not subjected to any major deformation when the tank is initially loaded. Also the capping should not be resilient so that the tank base is not elastically cycled when the tank is filled and emptied.

In the past, liquefied gas storage tank bases have been constructed with a layer of compressible material between the slabs of insulation. In the case of liquefied natural gas tanks, the capping layer is usually hot asphalt, an asphaltic based material or contains asphalt such as asphalt filled paper. In the base insulation of liquefied oxygen tanks, however, organic materials are not permissible, and asbestos paper is commonly used in place of asphaltic materials as a capping for the tank base insulation. Asbestos paper, however, as a capping layer presents a potential health hazard and is becoming less available. In addition to many conventional capping materials becoming commercially unfeasible because of high cost or unavailability, they exhibit properties which do not permit their use over a wide temperature range. Their properties are temperature sensitive, becoming brittle at cryogenic temperatures and fluid at elevated temperatures. Consequently, the use of such materials is restricted to the base insulation of tanks for the storage of liquids at cryogenic temperatures or at elevated temperatures, but not both.

Many of the conventional capping materials when applied as load bearing base insulation upon the surface of the cellular glass blocks tend to rebound from the surface of the blocks when compressed. The cellular glass blocks have a cut face that forms a plurality of open hemispherical cells. Preferably, the capping material should fill the cells to provide an effective capping layer between the courses of the cellular glass block base. Conventional capping materials having resilient properties may not effectively fill the open cells and subsequently the tank base is elastically deformed when the tank is filled and emptied. In addition, because these materials do not come into intimate contact with the cellular glass block surface, the compressive strength of such an insulation system is substantially reduced. For this reason they are ineffective as load bearing insulation.

There is need for an inorganic material for capping base insulation of liquefied gas storage tanks that completely fills the open hemispherical cells of the cellular glass blocks and comes into intimate contact therewith to form a capping layer that is irreversibly compressible to provide improved compressive strength for the base insulation. Furthermore, the inorganic capping material should be an effective loading bearing insulation at cryogenic temperatures and elevated temperatures as well.

SUMMARY OF THE INVENTION

In accordance with the present invention, there is provided a method and apparatus for capping cellular glass blocks for use as load bearing insulation for the base of liquefied gas storage tanks. The cellular glass blocks are prepared for capping by cutting a horizontal surface of the blocks to form a cut face having a plurality of open hemispherical cells. A layer of irreversibly compressible inorganic particulate material is applied to the surface of the cellular glass block cut face. The layer of inorganic particulate material penetrates the plurality of the open hemispherical cells to completely fill the cells. The layer of inorganic material is compressed to form a substantially planar surface having a preselected thickness on the cellular glass block cut face.

The irreversibly compressible inorganic particulate material, preferable vermiculite, adheres to the cellular glass block cut base by precompressing the layer under a preselected compressive force. In this manner the vermiculite material is compressed into the open hemispherical cells of the cellular glass blocks to form a capping layer thereon having a compressive strength in the range between about 90 p.s.i. to 180 p.s.i. As each course of cellular glass block base insulation is constructed the vermiculite particles are applied by screeding or rolling the particles over the open hemispherical cells of the cellular glass block.

Precompressing the vermiculite capping layer with a compressive force of up to 42 p.s.i. completely fills the open cells of the glass blocks. Preferably, the capping layer has a thickness in the range between about 3/16 inch to ¼ inch between each course of the cellular glass block.

Accordingly, the principal object of the present invention is to provide a method and apparatus for capping cellular glass blocks for use as load bearing insulation for the base of liquefied gas storage tanks where the capping material is an irreversibly compressible inorganic particulate material that completely fills the open cells of the cellular glass blocks to provide the cellular glass block insulation system with a capping having a high compressive strength independent of temperature.

Another object of the present invention is to provide a method and apparatus for capping cellular glass blocks for base insulation of liquefied gas storage tanks with an inorgnnic capping material that is easily applied to the cellular glass base insulation to provide improved compressive strength for the liquefied gas storage tank at cryogenic and elevated temperatures.

A further object of the present invention is to provide a method and apparatus for capping the cellular glass blocks of base insulation for liquefied gas storage tanks with vermiculite particles that increase the compressive strength of the base insulation by uniformly distributing the load applied to the cellular glass blocks.

These and other objects of the present invention will be more completely described and disclosed in the following specificaton, the accompanying drawings and the appended claims.

BRIEF DESCRIPTION OF THE DRAWINGS

FIG. 1 is a schematic sectional view of a liquefied gas storage tank having a base insulation of cellular glass blocks that are capped with a layer of vermiculite in accordance with the present invention.

FIG. 2 is a schematic view, illustrating in detail the capping layer that is provided between and on the cellular glass block layers of base insulation.

FIG. 3 is a schematic view of the cut face of a cellular glass block, illustrating the vermiculite compressed into the open hemispherical cells of the cellular glass block insulation.

DESCRIPTION OF THE PREFERRED EMBODIMENTS

Referring to the drawings and more particularly to FIG. 1 there is illustrated at low temperature or cryogenic storage tank 10 for the storage of liquefied gas such as liquid natural gas (LNG) and liquid oxygen (LOX). Practice of the present invention is not restricted to storage tanks for LNG or LOX, but is applicable to the storage of liquids at elevated temperatures, as for example the storage of hot chemicals. Furthermore, the present invention may be utilized with storage tanks supported above ground as on a pile cap foundation. The cryogenic tank 10 is a double wall vessel having an outer wall 12 spaced from an inner wall 14. The base of the outer wall 12 rests at ground level upon a circular concrete pad 16. The center portion of the concrete pad 16 is backfilled with earth 18 and a layer of sand 20 covers the earth 18 to the upper surface of the concrete pad. The sand layer 20 is provided with a center crown. The concrete pad 16 and the sand pad 20 support a base plate 22 of the outer wall 12. A leveling screed 24 of concrete or sand is poured on the base plate 22 of the outer wall 12 and serves as the base for the first course of cellular glass block insulation.

A ring 26 of cellular glass blocks are laid upon the leveling screed 24 adjacent the outer tank 12 and are arranged in a staggered array on the leveling screed 24. The cellular glass blocks of the insulation ring 26 and the remaining glass blocks utilized for insulation of the base of the cryogenic tank 10 are a shaped cellular glass article made from cellular glass nodules. U.S. Pat. Nos. 2,123,536; 2,611,712; 2,775,524; 2,860,997; 2,955,049 and 2,946,643 teach the making of cellular glass blocks for general insulation. Briefly, the process includes admixing pulverulent glass and a cellulating agent and subjecting the admixture to elevated cellulating temperature in a mold. The admixture softens and the cellulating agent reacts to cellulate the admixture and produce a shaped article of multicellular glass. The insulation blocks are thus formed from the blocks of the closed cell multicellular glass by cutting the block to the desired rectangular dimensions.

The cut face of the glass blocks has a plurality of open hemispherical cells 28 as illustrated in FIG. 3. As each course of the glass block insulation ring 26 is laid upon the leveling screed 24 inorganic particulate material, preferaly vermiculite, is spread in a suitable manner over the cut face of the glass block to penetrate and fill the open hemispherical cells 28. In this manner the vermiculite particles form a cap 30 between the layers of cellular glass block 26. Vermiculite is an irreversibly compressible material so that upon application the vermiculite particles compress under preloading to fill the open cells 28 of the cellular glass blocks.

A concrete bearing ring 32 is cast upon the glass block insulation ring 26 and serves as the base for the inner wall 14 of the double wall cryogenic tank 10. With the concrete bearing ring 32 in place a glass block insulation base 34 is set upon the leveling screed 24 within the glass block insulation ring 26. As with the glass block insulation ring 26, a vermiculite capping 30 is applied on the cut face of each of the cellular glass blocks of the insulation base 34 to penetrate and fill the open hemispherical cells thereof.

A sand pad 36 is spread over the capped surface of the upper course of cellular glass block base 34 to approximately the level of the upper surface of the concrete bearing ring 32. With this arrangement the upper surface of the concrete bearing ring 32 and the sand pad 36 receive the base plate 38 for the inner wall 14. Thus, the base plate 38 of the inner wall 14 is insulated by the array of cellular glass blocks 26 and 34 having the vermiculite capping 30. The construction of the cryogenic tank 10 is completed by providing a fiber glass expansion blanket 40 in abutting relationship with the inside surface of the outer wall 12 within the annulus formed by the inner and outer walls 12 and 14. The remaining space between the inner and outer walls 12 and 14 is filled with loose perlite 42 and a 1 p.s.i.g. purge of nitrogen or vaporized natural gas is injected within the annulus.

Referring to FIG. 3, the vermiculite particles are spread over the surface of the cut face of the cellular glass blocks and fill the open hemispherical cells 28. Compression of the vermiculite particles as they are spread over the surface of th cellular glass blocks crushes the particles to form platelet-like structures. Further application and compression of the vermiculite particles binds the platelet-like structure together. In this manner the open cells 28 are completely filled to thereby cap the cellular glass blocks.

Vermiculite is an irreversibly compressible inorganic material and therefore the platelet-like structures will not rebound from the open cells 28. With this arrangement a vermiculite capping 30 of a preselected minimum thickness is applied to each course of the cellular glass block insulation base 26 and 34. The irreversible compressibility of the vermiculite capping 30 assures that the base insulation of the cryogenic tank 12 will not be elastically cycled when the tank is filled and emptied. A limited degree of deformation will take place upon the initial penetration and packing of the vermiculite particles into the open cells 28 of the cellular glass blocks to completely fill the cells and cap the blocks.

The following examples illustrate the present invention but are not intended as limitations thereof.

EXAMPLE I

Compressive strength tests were run for capping of cellular glass block base insulation for liquefied gas in storage tanks using an Instron Universal Testing Machine, Model TTD. Each cellular glass block sample having a cut face forming open hemispherical cells was tested with one of three capping materials: hot asphalt (210°–200°F.) and 0.15 lb./ft.$^2$ felt, Johns-Mansville's 0.32 lb./ft.$^2$ asbestos paper having a thickness of 1/16 inch, and a layer of vermiculite aggregate. A course grade of granular vermiculite where the majority of the weight was between 8 and 50 Tyler standard screen mesh at a thickness in the range between about 3/16 to ¼ inch was applied to the cut surface of the cellular glass block samples by screeding with a frame. Each experimental capping was applied to nine samples.

An average compressive strength for the hot asphalt and felt capping of the insulation samples was measured at about 122 p.s.i. at an average density of about 8.69 lb./ft.$^3$. An average compressive strength for the asbestos paper was measured at about 78 p.s.i. at an average density of about 8.83 lb./ft.$^3$. The vermiculite capping was measured to have an average compressive strength of about 149 p.s.i. at an average density of about 8.59 lb./ft.$^3$.

The test results indicated the vermiculite capping to be a superior soft inorganic capping material having a high compressive strength and irreversibly compressible upon loading. As the vermiculite capping layer was applied the particles were precompressed under a load of about 42 p.s.i. and consequently crushed to fill the open cells of the cellular glass blocks and bring the particles into intimate contact with the open cells. In this manner the layer of crushed vermiculite functioned to distribute the compressive forces over the surface of the cellular glass blocks.

EXAMPLE II

The effect of temperature on the compressive strength of cellular glass block insulation with vermiculite capping was tested using an Instron Universal Testing Machine, Model TTD, at a constant strain rate using a cross head speed of 0.05 in./min. at both room temperature and at cryogenic temperature. A two layer stack of 9 inch × 12 inch ×5 inch cellular glass blocks were capped with vermiculite and were measured to have an average compressive strength of about 133.8 p.s.i. at cryogenic temperature. For an identical test sample the compressive strength of the cellular glass block insulation capped with vermiculite at room temperature was measured at an average of about 124.7 p.s.i. From these results it may be concluded that vermiculite possesses superior compressive strength as a capping material for cellular glass block insulation at room temperature and at cryogenic temperature as well. In addition for the above test sample capped with hot asphalt, at room temperature an average compressive strength of 134.1 p.s.i. was measured. This indicates that the compressive strength of the vermiculite capping at room temperature is comparable to that of hot asphalt.

EXAMPLE III

A comparison of the deformation properties between vermiculite capping and alternative capping materials for cellular glass block insulation was conducted using an Instron Universal Testing Machine, Model TTD. Four blocks of 5 inch cellular glass block insulation and five blocks of 4 inch cellular glass block insulation were cut into quadrants. One quadrant of each cellular glass block sample was tested with each of three capping materials: hot asphalt (210°–220°F.); Johns-Manville's 0.32 lb./ft.$^2$ asbestos paper (single layer, 1/16 inch thick); and a layer of vermiculite aggregate (course grade) at a thickness between about 1/8 inch to 3/16 inch. A frame was used for screeding the layer of vermiculite on the surface of the glass blocks.

The following table illustrates the deformation properties of the various capping materials. It should be noted that the measured deformation includes the penetration and packing of the capping material into the top surface layer of the open hemispherical cells of the cellular glass block insulation as well as elastic/plastic deformations within the capping material and in the elastic deformation of the cellular glass block insulation.

DEFORMATION PROPERTIES OF TWO-LAYER CAPPING

| Capping | Capping Thickness (two layers) at 1 p.s.i. (inch) | at 41.7 p.s.i. (inch) | at Failure Stress (inch) | Deformation at 41.7 p.s.i. (inch) | at Failure Stress (inch) |
|---|---|---|---|---|---|
| .32 lb./ft$^2$ asbestos paper | .126±.010 | .088 | .068(78 p.s.i.) | .038 | .058 |
| Nominal 3/16" Vermiculite | .381±.031 | .176 | .057(148 p.s.i.) | .205 | .325 |
| Hot Asphalt Only (210–220°F;0.20 lb./ft$^2$) | .085±.013 | .068 | .058(125 p.s.i.) | — | .027 |

According to the provisions of the patent statutes, I have explained the principle, preferred construction and mode of operation of my invention and have illustrated and described what I now consider to represent its best embodiments. However, it should be understood that the invention may also be practiced otherwise than as specifically illustrated and described.

I claim:

1. Load bearing insulation for the base of a liquefied gas storage tank having a cylindrical outer wall spaced from a cylindrical inner wall comprising, first support means for supporting said tank outer wall, said first support means having an upper horizontal surface, a plurality of horizontally positioned insulation blocks arranged in layers on said first support means upper horizontal surface within said tank outer wall, said layers of insulation blocks each having an upper horizontal surface, a capping layer of irreversibly compressible inorganic particulate material applied to each horizontal surface of said layers of insulation block to form a load bearing insulation therefor, and second support means for supporting said tank inner wall and said tank base.

2. Load bearing insulation for the base of a liquefied gas storage tank having a cylindrical outer wall spaced from a cylindrical inner wall as set forth in claim 1 which includes, said second support means being positioned on the uppermost layer of said insulation blocks having said capping layer positioned thereon.

3. Load bearing insulation for the base of a liquefied gas storage tank having a cylindrical outer wall spaced from a cylindrical inner wall as set forth in claim 1 in which each of said insulation blocks includes, a preshaped body of multicellular glass, said multicellular glass body having a cut upper horizontal surface forming a plurality of open hemispherical cells thereon.

4. Load bearing insulation for the base of a liquefied gas storage tank having a cylinddrical outer wall spaced from a cylindrical inner wall as set forth in claim 3 which includes, said inorganic particulate material covering said multicellular glass body cut surface and completely filling said open cells to thereby form an irreversibly compressible cap between said layers of multicellular glass bodies.

5. Load bearing insulation for the base of a liquefied gas storage tank having a cylindrical outer wall spaced from a cylindrical inner wall as set forth in claim 4 which includes, said inorganic particulate material arranged to crush upon application of a preselected compressive force to said multicellular glass bodies and form a platelet-like structure of inroganic particulate material on said multicellular glass bodies.

6. Load bearing insulation for the base of a liquefied gas storage tank having a cylindrical outer wall spaced from a cylindrical inner wall as set forth in claim 4 which includes, said irreversibly compressible cap between said layers of multicellular glass bodies having a thickness in the range between about 3/16 inch to ¼ inch and being temperature insensitive.

7. Load bearing insulation for the base of a liquefied gas storage tank having a cylindrical outer wall spaced from a cylindrical inner wall as set forth in claim 4 which includes, each of said multicellular glass bodies capped with a layer of said inorganic particulate material having a compressive strength in the range between about 90 p.s.i. to 180 p.s.i.

8. Load bearing insulation for the base of a liquefied gas storage tank having a cylindrical outer wall spaced from a cylindrical inner wall as set forth in claim 1 wherein, said capping layer of irreversibly compressible inorganic particulate material includes vermiculite particles.

9. Load bearing insulation for the base of a liquefied gas storage tank having a cylindrical outer wall spaced from a cylindrical inner wall as set forth in claim 8 which includes, said vermiculite particles having a spectrum of sizes in the range between about 8 to 50 Tyler standard screen mesh.

10. Load bearing insulation for the base of a liquefied gas storage tank having a cylindrical outer wall spaced from a cylindrical inner wall as set forth in claim 1 in which said first support means includes, a circular concrete pad, a base plate positioned on said concrete pad within said tank outer wall, and a lower leveling screed covering said base plate and arranged to receive said layers of insulation block.

11. Load bearing insulation for the base of a liquefied gas storage tank having a cylindrical outer wall spaced from a cylindrical inner wall as set forth in claim 1 in which said second support means includes, a concrete bearing ring cast upon the upper surface of said load bearing insulation, an inner array of insulation block layers positioned within said concrete bearing ring, a layer of irreversibly compressible inorganic particulate material positioned between the layers of said inner array of insulation block, and an upper leveling screed covering said concrete bearing ring and said inner array of insulation block layers for receiving said tank inner wall and said tank base.

12. Load bearing insulation for the base of a liquefied gas stroage tank having a cylindrical outer wall spaced from a cylindrical inner wall as set forth in claim 11 in which, said layer of irreversibly compressible inorganic particulate material positioned between the layers of said inner array of insulation block includes vermiculite particles.

* * * * *